US010059095B2

(12) United States Patent
Koerner et al.

(10) Patent No.: US 10,059,095 B2
(45) Date of Patent: Aug. 28, 2018

(54) METHOD TO REDUCE AN INCREASED VISCOSITY IN AN INK PRINT HEAD OF AN INK PRINTER

(71) Applicant: Océ Printing Systems GmbH & Co. KG, Poing (DE)

(72) Inventors: Philippe Koerner, Forstinning (DE); Ulrich Stoeckle, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 18 days.

(21) Appl. No.: 15/278,955

(22) Filed: Sep. 28, 2016

(65) Prior Publication Data

US 2017/0096002 A1 Apr. 6, 2017

(30) Foreign Application Priority Data

Oct. 1, 2015 (DE) ..... 10 2015 116 656

(51) Int. Cl.
*B41J 2/045* (2006.01)
*B41J 2/165* (2006.01)

(52) U.S. Cl.
CPC ..... *B41J 2/0451* (2013.01); *B41J 2/04581* (2013.01); *B41J 2/04596* (2013.01); *B41J 2/165* (2013.01); *B41J 2/04598* (2013.01); *B41J 2/1652* (2013.01)

(58) Field of Classification Search
CPC .. B41J 2/0451; B41J 2/04581; B41J 2/04596; B41J 2/04598; B41J 2/165; B41J 2/1652
See application file for complete search history.

(56) References Cited

U.S. PATENT DOCUMENTS 8,733,882 B2 5/2014 Yudasaka et al.
2006/0071964 A1* 4/2006 Oku ..... B41J 2/0451 347/19
2013/0307896 A1* 11/2013 Shinkawa ..... B41J 29/393 347/19
2015/0352841 A1 12/2015 Horie

FOREIGN PATENT DOCUMENTS

WO WO 2009128572 A1 * 10/2009 ..... B41J 2/04508

* cited by examiner

*Primary Examiner* — Sharon A Polk
(74) *Attorney, Agent, or Firm* — Schiff Hardin LLP

(57) ABSTRACT

A method for reducing a locally increased viscosity of ink in an ink print head of an ink printer during printing operation includes: a determination of a printing pause with the aid of a pixel preview; an application of a first sequence of pulses for measurement of the activation current of a piezoelement of the ink print head; and an application of a second sequence of pulses for vibration of the ink meniscus at the exit of a nozzle if the ink print head to intermix the ink having locally increased viscosity with ink having the initial viscosity given a threatened failure of the nozzle.

11 Claims, 6 Drawing Sheets

METHOD TO REDUCE AN INCREASED VISCOSITY IN AN INK PRINT HEAD OF AN INK PRINTER

CROSS REFERENCE TO RELATED APPLICATIONS

This patent application claims priority to German Patent Application No. 102015116656.9, filed Oct. 1, 2015, which is incorporated herein by reference in its entirety.

BACKGROUND

Field

The disclosure is directed to a method for reducing a locally increased viscosity of ink in an ink print head of an ink printer during the printing operation. The ink print head can include at least one nozzle configured to eject at least one ink droplet.

Related Art

The function of an ink print head (in particular of a piezo-"inkjet" print head) may be negatively affected by external influences such as environment conditions (e.g., climate, a lack of print utilization etc.). In particular, a drying out or clogging of one or more nozzles of the ink print head may thereby occur due to an evaporation of water or solvents from the ink via the nozzle opening of the respective nozzle. Due to the resulting change of the viscosity of the ink in the nozzle channel of the respective nozzle, the printing capability of the ink varies, and disruptions such as nozzle failures or ink droplets with unwanted properties (in particular with regard to their velocity and/or their volume) may occur. These disruptions in particular lead to a negative effect on or degradation of the print quality, for example due to streaks or a missing print image information.

The implementation of an automatic process for detection of a clogged nozzle of an ink print head is described in, for example, U.S. Pat. No. 8,733,882.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
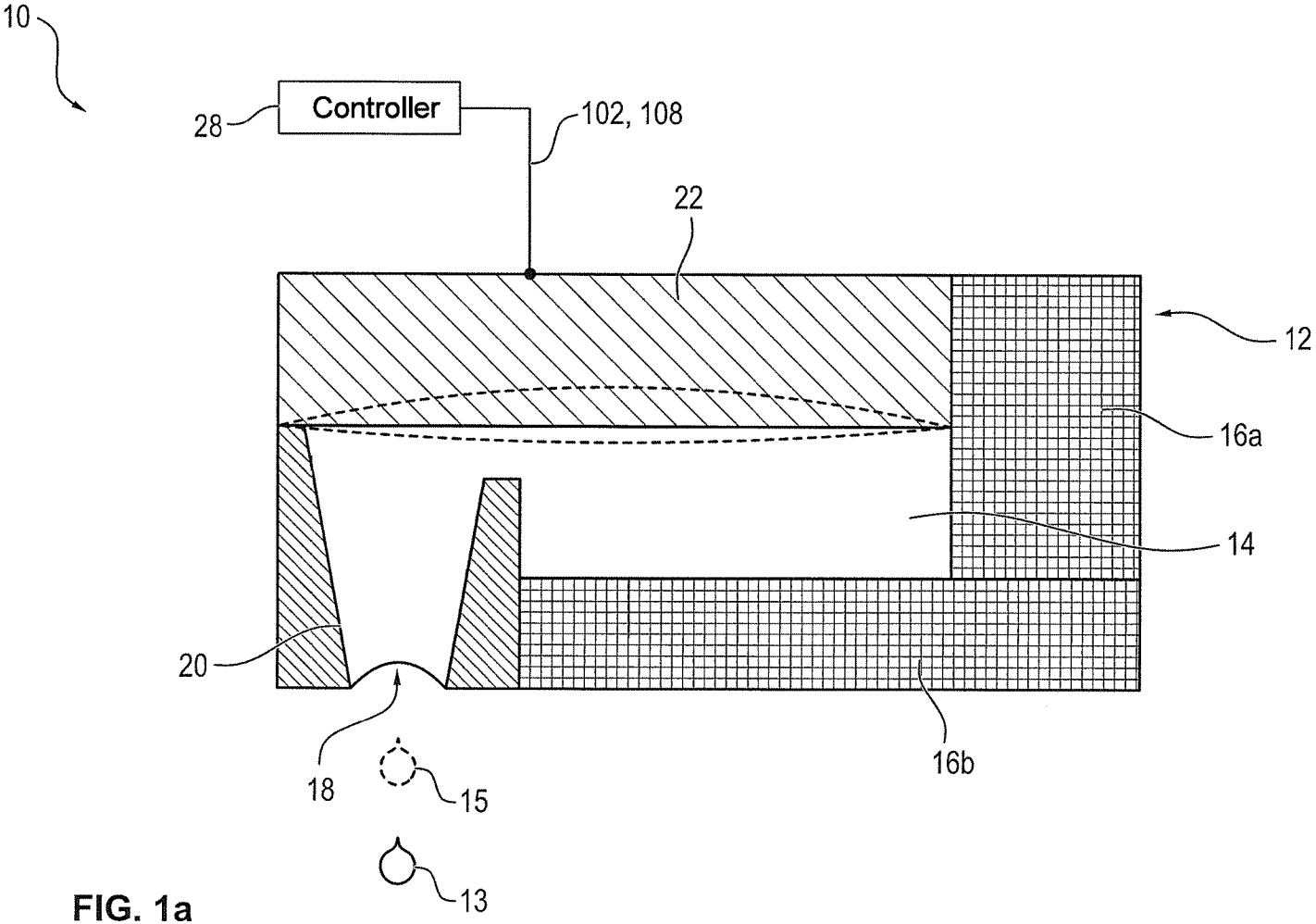

FIG. 1*a* illustrates a device configured to detect a status of ink in an ink print head having a piezoelement according to an exemplary embodiment of the present disclosure.

Figure 1B:
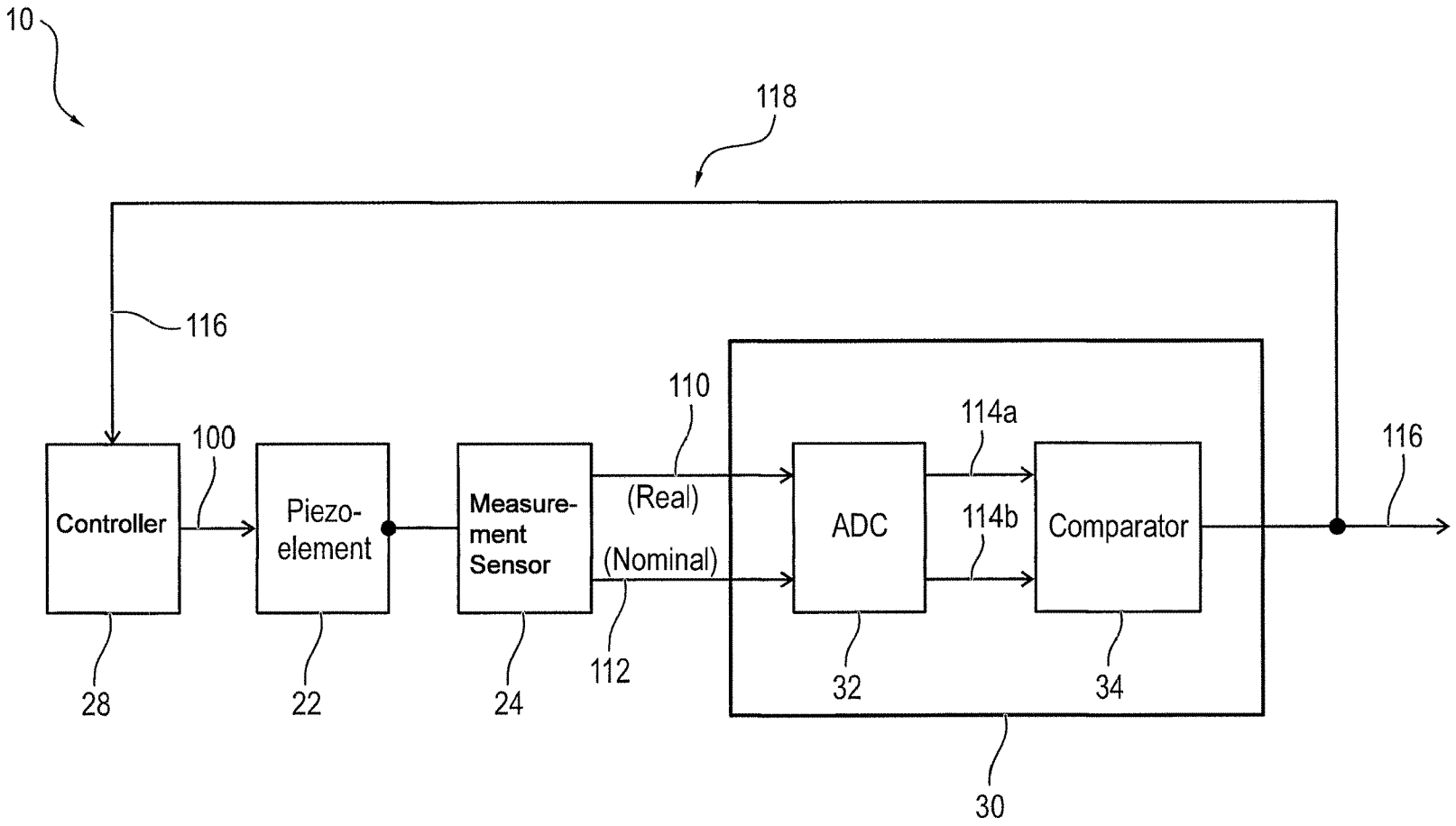

FIG. 1*b* illustrates device configured to detect a status of ink in an ink print head having a controller and an evaluator according to an exemplary embodiment of the present disclosure.

Figure 2A:
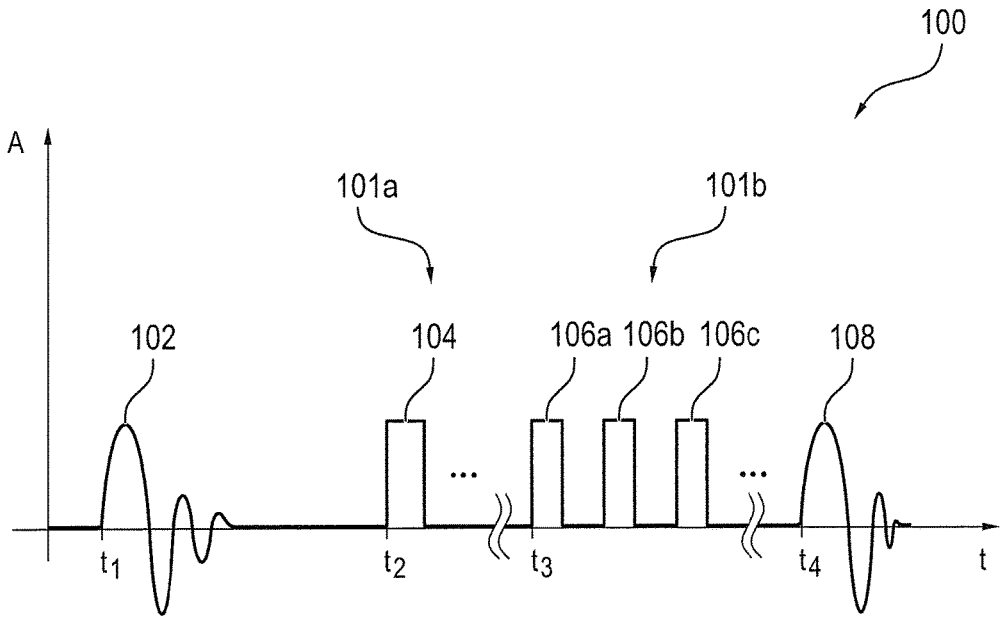

FIG. 2*a* illustrates a sequence of control pulses according to an exemplary embodiment of the present disclosure to activate a piezoelement such as the piezoelement shown in FIG. 1*a*.

Figure 2B:
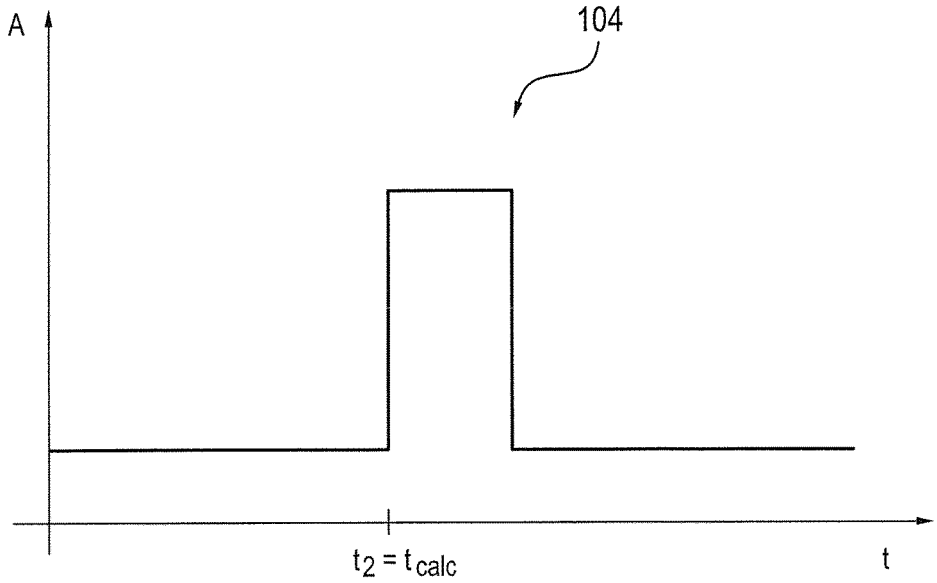

FIG. 2*b* illustrates an excitation pulse of the sequence of control pulses shown in FIG. 2*a*.

Figure 3:
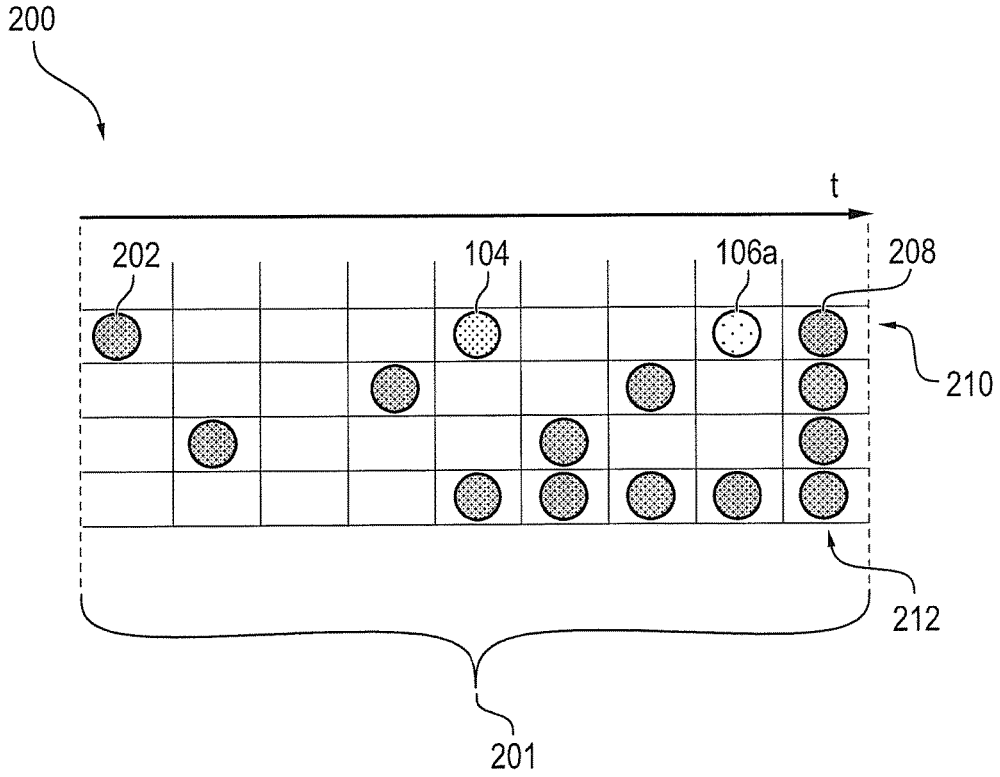

FIG. 3 illustrates print data points of a data stream for generating a corresponding print image according to an exemplary embodiment of the present disclosure.

Figure 4A:
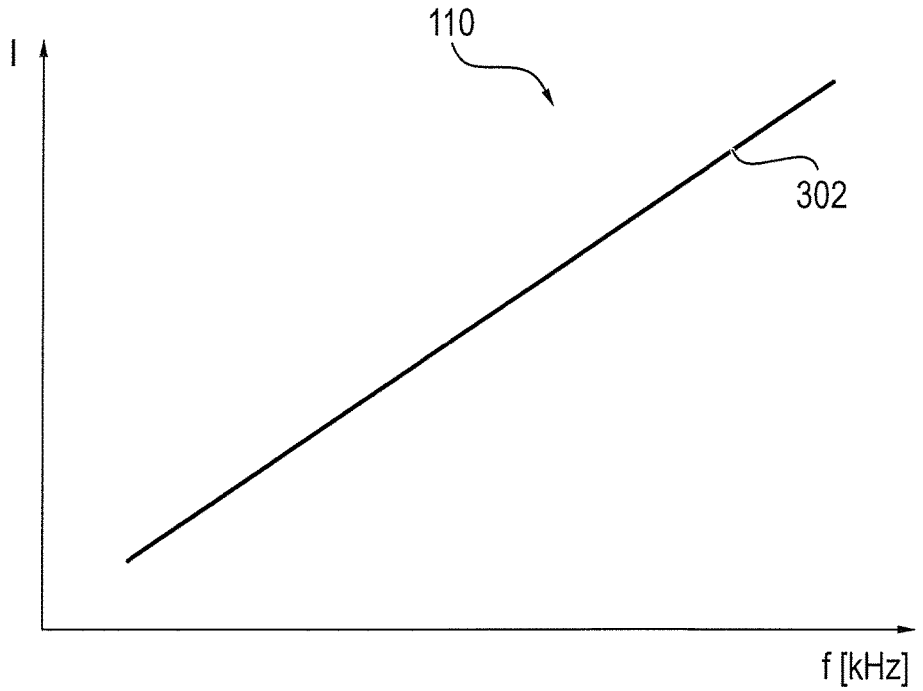

FIG. 4*a* illustrates a response signal according to an exemplary embodiment of the present disclosure of the piezoelement shown in FIG. 1*a*, with a first signal curve.

Figure 4B:
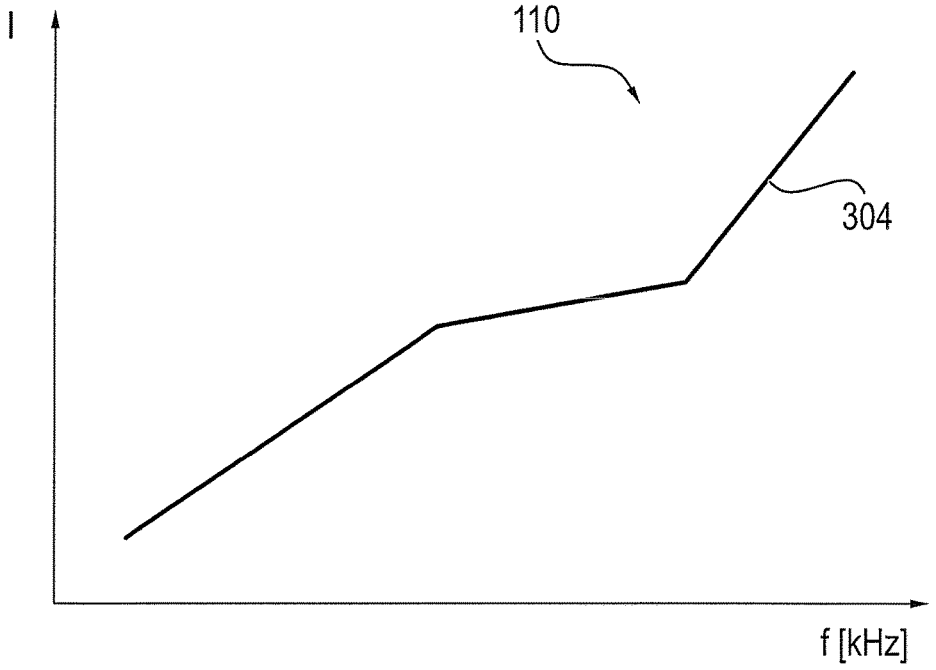

FIG. 4*b* illustrates a response signal according to an exemplary embodiment of the present disclosure of the piezoelement shown in FIG. 1*a*, with a second signal curve.

Figure 5:
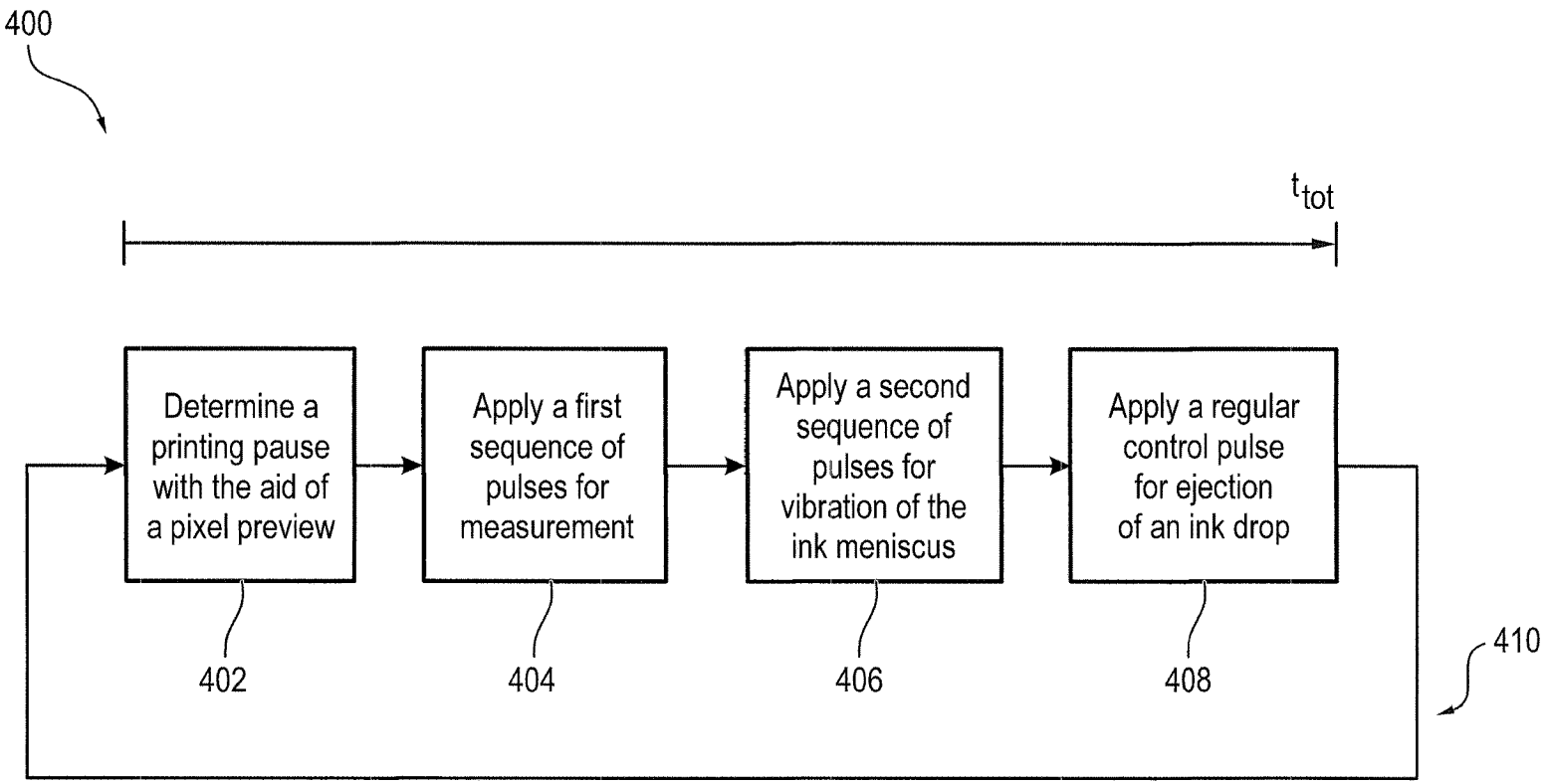

FIG. 5 illustrates flowchart of a method according to an exemplary embodiment of the present disclosure that can be executed with the aid of the device according to FIG. 1*a*.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is a method for reducing an increased viscosity (e.g., a locally increased viscosity) of ink in an ink print head of an ink printer during the printing operation to improve print quality.

An improved print quality is achieved via a method that includes a printing pause of a nozzle of the ink print head that is to be examined is determined with the aid of a pixel preview. In the determined printing pause, a first sequence of pulses with adjustable parameters of this sequence is applied to a piezoelement of the ink print head if the determined printing pause reaches or exceeds a predetermined threshold. A real curve of an activation current of the piezoelement is determined depending on at least one of the adjustable parameters of the first sequence of pulses. The determined real curve is compared with a predetermined nominal curve of the activation current of the piezoelement. Depending on the result of this comparison it is detected whether a failure of the nozzle threatens due to a locally increased viscosity (in comparison with an initial viscosity) of the ink at the exit of the nozzle. A second sequence of pulses with adjustable parameters of this sequence is applied to the piezoelement in order to generate a vibration of the meniscus of the ink at the exit of the nozzle in order to intermix the ink having locally increased viscosity with ink having the initial viscosity, if it has been detected that the nozzle is threatened with failure. An information about the status of the ink in the ink print head may thus be obtained. Suitable measures for reestablishing the desired state of the ink—for example a cleaning of the ink print head or a vibration of the ink meniscus, and therefore intermixing of the ink in the nozzle channel—may be taken depending on this information. With the aid of these measures, a drying of the ink in the nozzle or a clogging of the nozzle due to a locally increased viscosity of the ink may be delayed. The printing capability of the ink may thereby be significantly maintained or reestablished. Disruptions—in particular nozzle failures or ink droplets having unwanted properties—may thereby also be avoided. A negative effect on or a degradation of the print quality may thus be prevented, or at least reduced.

In an exemplary embodiment, during printing, whether nozzle failures threaten due to increased viscosity is detected. The viscosity of the ink increases at the nozzle output if no droplet has been ejected for a longer period of time. It is precisely those shorter ejection pauses that are therefore detected via the pixel preview. In this time period, a measurement signal with specific frequency/amplitude is provided to the piezoelement. A droplet should not be ejected via this. The activation current is measured and compared with a nominal current. The nominal current is obtained if the activation current of the piezoelement is measured immediately after the "purge" (cleaning) process of the nozzle. If the real value deviates from the nominal value, something is not right with the ink in the nozzle channel or it is already partially clogged (viscosity increased). A vibration of the meniscus at the nozzle output may now be implemented in order to intermix the ink and intermix ink having high viscosity with fresh ink (lower viscosity), so that no printing errors are visible due to the viscosity change and a clogging is prevented. The measurement cycle in particular amounts to a multiple of the drop-to-drop time (i.e. a multiple of 15 μs to 25 μs). The measurement should not begin immediately with the last ejection of a drop because the nozzle is still functioning property at this point in time. Also, no ejection of drops should fall within the measurement time period.

In an exemplary embodiment, upon application of the first sequence of pulses, a frequency of this sequence is set. The determination of the real curve of the activation current is also implemented depending on this frequency. A suitable response signal—i.e. the real curve of the activation current—may thus be provided for the evaluation.

In an exemplary embodiment, upon application of the second sequence of pulses, a number of pulses (possibly frequency and amplitude) of this sequence is set based on a deviation of the real curve of the activation current from the nominal curve. The activation of the piezoelement may thus be realized using a suitable number of excitation pulses (also designated as "prefire" pulses) with the aid of which the ink in the ink print head may be brought from an unwanted state into the desired state. For example, this state is characterized by a minimal viscosity of the ink or by a minimal proportion of air in the ink. The excitation pulses serve to generate the vibration of the ink meniscus at the output of the nozzle channel without a drop thereby being ejected. The ink is thereby intermixed so that no locations having increased viscosity (for example locations with dried-up ink) are created. In particular, the ink in the nozzle channel is intermixed so that the viscosity is distributed uniformly across the nozzle channel, and no locations with significantly increased viscosity are created.

In exemplary embodiments, faulty nozzles (for example dried-up ink or clogged nozzles) during the printing operation are detected without influencing the printing operation.

In exemplary embodiments, print quality disruptions are detected without the use of a complicated inspection of the print image using, for example, a camera/scanner. Furthermore, a feedback system ("closed loop" system) may also be realized with the aid of the present disclosure, in which an error information signal (which indicates an error given a deviation of the real curve of the activation current from the nominal curve) is relayed via a feedback path to a controller. The controller can be configured to activate the piezoelement to compensate for non-printing nozzles via the use of neighboring nozzles.

FIG. 1*a* illustrates an exemplary embodiment of a device 10 configured to detect a status of ink in an ink print head 12 having a piezoelement 22. The piezoelement 22 can be, for example, a piezoelectric actuator, a piezoelectric crystal, or another piezoelectric device as would be understood by one of ordinary skill in the art. The device 10 has the ink print head 12. The ink print head 12 comprises an ink chamber 14. The ink chamber 14 can be filled with the ink. Wall elements 16*a*, 16*b* serve for lateral and lower delimitation of the ink chamber 14.

The ink print head 12 also comprises at least one nozzle 18 and the piezoelement 22. The nozzle 18 comprises a nozzle channel 20 that tapers towards the underside of the ink print head 12. The ink chamber 14 is laterally bounded by the nozzle channel 20, whereas it is upwardly bounded by the piezoelement 22. In the filled state, the ink is located in the ink chamber 14 comprising the nozzle 18.

In the exemplary embodiment shown in FIG. 1*a*, the piezoelement 22 can be activated—using at least one of the control pulses 102, 108 provided by the controller 28—such that it is excited and produces an ejection of at least one ink drop 13, 15 from the nozzle 18.

FIG. 1*b* shows a schematic block diagram of a device 10 for detecting a status of ink in an ink print head 12 having a controller 28 and an evaluator 30 according to an exemplary embodiment. In the exemplary embodiment, the device 10 comprises the piezoelement 22 shown in FIG. 1*a*. The device 10 also comprises a measurement sensor 24. In an exemplary embodiment, the controller 28 is configured to generate a sequence 100 of control pulses to activate the piezoelement 22. The measurement sensor 24 is configured to measure the piezoelement 22 and generate and output a real curve of an activation current of the piezoelement 22 as a first analog response signal 110 and a nominal curve of the activation current of the piezoelement 22 as a second analog response signal 112.

In an exemplary embodiment, the evaluator 30 includes an analog-to-digital converter (ADC) 32 and a comparator 34. The ADC 32 is configured to convert the first analog response signal 110 and the second analog response signal 112 to obtain a first digital response signal 114*a* and a second digital response signal 114*b*, respectively. The comparator 34 is configured to compare the first digital response signal 114*a* and the second digital response signal 114*b* to obtain an error information signal 116. The comparator 34 can be, for example, an operational amplifier, but is not limited thereto.

In the exemplary embodiment of FIG. 1*b*, the evaluator 30 is configured to generate the error information signal 116 based on a nominal/real comparison of the digital response signals 114*a*, 114*b* that are derived from the corresponding analog response signals 110, 112.

In an exemplary embodiment, the controller 28, the measurement sensor 24, and/or the evaluator 30 include processor circuitry configured to perform the respective functions of the controller 28, measurement sensor 24, and the evaluator 30, respectively.

As illustrated in FIG. 1*b*, the error information signal 116 may also be fed back from the evaluator 30 to the controller 28 via a feedback path 118. The controller 28 may also be configured to generate a suitable sequence 100 of control pulses based on fed back error information signal 116. This fed back signal 116 can be used to bring the ink into its desired state again given the presence of an unwanted state of the ink.

In an exemplary embodiment, the nominal curve—i.e. the response signal 112—is obtained from the activation current determined immediately after a flushing of the nozzle 18.

FIG. 2*a* shows a schematic depiction of an example of a sequence 100 of control pulses 102 through 108 used to activate the piezoelement 22 of FIG. 1*a*. In particular, in FIG. 2*a*, the amplitude (A) is plotted as a function of the time (t). In an exemplary embodiment, the controller 28 can be configured to generate the sequence 100 of control pulses 102 through 108 illustrated in FIG. 2*a* such that the sequence 100 includes at least a first through fourth control pulse 102, 104, 106*a*, 108. With regard to FIGS. 1*a* and 2*a*, the first control pulse 102 is a first regular control pulse to generate a first ink droplet 13 to be ejected. The second control pulse 104 is an excitation pulse to excite the piezoelement 22 and to generate the response signal 110. The third control pulse 106*a* is an excitation pulse to vibrate the meniscus of the ink in the ink print head 12. The fourth control pulse 108 is a second regular control pulse to generate a next ink droplet 15 to be ejected.

As schematically depicted in FIG. 2*a*, the first control pulse 102 and the fourth control pulse 108 are pulses having a relatively long pulse duration and a relatively complex pulse structure, whereas the second control pulse 104 and the third control pulse 106*a* are pulses having a relatively short pulse duration and a relatively simple pulse structure. For example, the second control pulse 104 and the third control pulse 106*a* are rectangular pulses. The first through fourth control pulse 102, 104, 106*a* and 108 are generated at the points in time $t_1$, $t_2$, $t_3$ or $L_1$. In particular, the points in time $t_2$, $t_3$ of the generation of the second and third control pulse 104, 106*a* lie between the points in time $t_1$, $L_1$ of the generation of the first and fourth control pulse 102, 108.

In an exemplary embodiment, the sequence 100 of control pulses 102 through 108 that is generated using the controller 28 shown in FIG. 1*b* comprises at least two additional excitation pulses 106*b*, 106*c* to vibrate the meniscus of the ink in the ink print head 12. The third control pulse 106*a* and the two additional excitation pulses 106*b*, 106*c* thereby form a sequence 101*b* of chronologically successive excitation pulses or prefire pulses. For example, the excitation pulses 106*a* through 106*c* of this sequence 101*b* have an identical pulse duration and an identical pulse structure. Furthermore, the excitation pulses 106*a* through 106*c* of this sequence 101*b* may also have the same time intervals from one another. In an exemplary embodiment, the excitation pulses 106 of the sequence 101*b* can have different time intervals, durations, and/or pulse structures.

In an exemplary embodiment, the prefire pulses of the sequence 101*b* respectively have a pulse structure that is characterized by an addition of a Dirac pulse and a saw tooth pulse.

In an exemplary embodiment, the controller 28 is configured to set the number of excitation pulses 106*a* through 106*c* within the sequence 100 of control pulses 102 through 108 that is shown in FIG. 2*a*, based on the response signal 110. For example, the number of these excitation pulses 106*a* through 106*c* may be set based on the deviation of the first response signal 110 from the second response signal 112.

FIG. 2*b* shows a schematic depiction of an example of an excitation pulse 104 of the sequence 100 of control pulses 102 through 108 that is shown in FIG. 2*a*. In FIG. 2*b*, the amplitude (A) is plotted as a function of time (t). In an exemplary embodiment, the excitation pulse 104 shown in FIG. 2*b* corresponds to the control pulse 104 generated at the point in time $t_2$, which is the second control pulse within the sequence 100 of control pulses 102 through 108 according to FIG. 2*a*. In particular, the excitation pulse 104 according to FIG. 2*b* is configured for the excitation of the piezoelement 22 and for generation of the response signal 110. As schematically depicted in FIG. 2*b*, this excitation pulse 104 is generated at a predetermined point in time $t_{calc}$, for example. The predetermined point in time $t_{calc}$ thereby, lies between the points in time $t_1$, $t_4$ of the first and second regular control pulse 102, 108 that are shown in FIG. 2*a*. The excitation pulse 104 generated at the predetermined point in time $t_{calc}$ may also be designated as a measurement pulse.

In an exemplary embodiment, the sequence 100 of control pulses 102 through 108 additionally includes excitation pulses designated as measurement pulses. These additional excitation pulses are not shown in FIG. 2*a*. The excitation pulse 104 and the additional excitation pulses not shown in FIG. 2*a* form a sequence 101*a* of chronologically successive excitation pulses or measurement pulses. In particular, the measurement pulses of the sequence 101*a* are generated chronologically before the prefire pulses of the sequence 101*b*.

FIG. 3 shows a schematic depiction for the illustration of examples of print data points 201 of a print data stream 200 for generation of a corresponding print image. The print data points 201 are depicted as dark grey circles in FIG. 3. In particular, the print data points 201 serve for generation of corresponding image points or pixels within the print image to be printed. As schematically depicted in FIG. 3, the print data points 201 are arranged in a time-slot pattern, wherein the time runs from left to right (time axis t).

First and second print data points 202 and 208 are schematically depicted in a first row 210 of this time-slot pattern. According to FIG. 3, the first and the second print data point 202 and 208 thereby correspond to the first and second regular control pulse 102 and 108 of the sequence 100 according to FIG. 2*a*. The first print data point 202 is associated with the first regular control pulse 102 generated at the point in time $t_1$. The measurement pulse 104 is generated at a time measurement point $t_2$. The prefire pulse 106*a* is generated at the point in time $t_3$. The second print data point 208 is associated with the second regular control pulse 108 generated at the point in time $t_4$. The print data points arranged in the right column 212 of the time-slot pattern are associated with multiple nozzles of the ink print head that are arranged next to one another in a row.

In an exemplary embodiment, the ink print head 12 includes multiple piezoelements that are associated with respective different nozzles of the ink print head.

FIGS. 4*a* and 4*b* show schematic depictions of an example of a response signal 110 of the piezoelement 22 shown in FIG. 1*a*, with a first or second signal curve 302, 304. The response signal 110 shown in FIGS. 4*a* and 4*b* with respective signal curve 302, 304 corresponds to the current consumption of the piezoelement 22 depending on the frequency of the sequence 101*a* shown in FIG. 2*a*. This sequence 101*a* of measurement pulses may also be designated as a measurement signal. In FIGS. 4*a* and 4*b*, the respective current consumption (I) is plotted as a function of the frequency (f in kHz). In an exemplary embodiment, the frequency f includes frequency values through a maximum of 64 kHz, but is not limited to this exemplary frequency range.

In the event that the frequency-dependent current consumption I (or the activation current) of the piezoelement 22 is characterized by a first signal curve 302 corresponding to a predetermined nominal curve of the activation current (FIG. 4*a*), the response signal 110 indicates a desired status of the ink in the ink print head 12. In the event that the frequency-dependent current consumption I of the piezoelement 22 is characterized by the second signal curve 304 deviating from the nominal curve of the activation current, the response signal 110 indicates an unwanted status of the ink in the ink print head 12. The status of the ink thus may be established simply and reliably using the signal curve of the frequency-dependent current consumption I of the piezoelement 22 that is depicted as an example in FIG. 4*a* or 4*b*.

FIG. 5 shows a flowchart of a method 400 according to an exemplary embodiment. The method 400 can be executed with the aid of the device 10 of FIG. 1*a*. In an exemplary embodiment, the method 400 includes the steps 402 through 408 running in chronological succession.

In Step 402, a printing pause of the nozzle 18 of the ink print head 12 that is to be examined is determined with the aid of a pixel preview.

In Step 404, the first sequence 101*a* of pulses having adjustable parameters of this sequence is applied to the piezoelement 22 of the ink print head 12 if the determined printing pause reaches or exceeds a predetermined threshold. A real curve of an activation current of the piezoelement 22 is determined based on at least one of the adjustable parameters of the first sequence 101*a* of pulses. The determined real curve is compared with a predetermined nominal curve of the activation current of the piezoelement 22. Depending on the result of this comparison, it is detected whether a failure of the nozzle 18 has occurred (or is likely to occur) due to a viscosity of the ink at the exit of the nozzle 18 that is locally increased in comparison with an initial viscosity.

In Step 406, the second sequence 101*b* of pulses with adjustable parameters of this sequence is applied to the piezoelement 22 to generate a vibration of the meniscus of the ink at the exit of the nozzle 18 to intermix the ink having locally increased viscosity with ink having the initial viscosity. The application of the second sequence 101*b* can be performed if it is detected that the failure of the nozzle 18 threatens (is likely).

In Step 408, a regular control pulse is applied to the piezoelement 22 to produce the ejection of an ink drop ("dot"). The total duration ($t_{tot}$) that is required for the implementation of Steps 402 through 408 is schematically depicted in FIG. 5. Steps 402 through 408 may also be implemented repeatedly, as is schematically indicated by the feedback loop 410. In this example, Step 402 corresponds to a "pixel preview" function, whereas Step 406 corresponds to a "prefire" function. The "pixel preview" function thereby serves to determine the time (printing pause t) until the ejection of the next ink drop. In an exemplary embodiment, the initial viscosity corresponds to a minimal viscosity of the ink in the ink print head 12.

In an exemplary embodiment, the threshold for the implementation of Step 404 lies within a range of 100 ms to a few seconds, but is not limited thereto. For example, the threshold can be 100 ms, 0.5 s or 1 s. In an exemplary embodiment, the adjustable parameters of the first sequence 101*a* of pulses and the adjustable parameters of the second sequence 101*b* of pulses respectively include an adjustable frequency, an adjustable amplitude and/or an adjustable number of pulses of the respective sequence.

In an exemplary embodiment, upon application of the first sequence 101*a* of pulses (Step 404), a frequency of this sequence is set. The determination of the real curve of the activation current can also be implemented based on this frequency. In an exemplary embodiment, in Step 404, the frequency is varied over time such that the corresponding period duration becomes increasingly smaller as time becomes longer. For example, the period duration is thereby defined as a time interval of the rising or falling edge of two adjacent rectangular pulses of the sequence 101*a*.

In an exemplary embodiment, upon application of the second sequence 101*b* of pulses (Step 406), a count of the pulses of this sequence is adjusted based on a deviation of the real curve of the activation current from the nominal curve. In an exemplary embodiment, in Step 406, the count of pulses is increased the greater the deviation of the real curve of the activation current from the nominal curve. In a non-limiting example, the count of the pulses is at least 3, at least 10 or at least 100.

In an exemplary embodiment, an amplitude of the first sequence 101*a* of pulses and an amplitude of the second sequence 101*b* of pulses are respectively permanently sequenced in Steps 404, 406, for example. In particular, no ejection of ink drops from the nozzle 18 also takes place in Steps 404, 406. The ejection of ink drops from the nozzle 18 takes place only upon application of a regular control pulse (Step 408).

In an exemplary embodiment, in Step 402, the printing pause is determined from print data points of a diffractive structure (for example, the print data points 201 of the data stream 200 shown in FIG. 3).

In an exemplary embodiment, Step 402, shown in FIG. 5, serves to determine the "Non Printing Time" (NPT) (e.g., the printing pause) in order to later determine a suitable point in time for measurement using the measurement pulse 104, or for excitation using the prefire pulse 106*a*, as was depicted by way of example using FIG. 3 (see in particular the first row 210 of the time-slot pattern of the print data stream 200).

In an exemplary embodiment, the point in time ($t_2$ or $t_3$) is determined so as to not interfere with the printing operation, and to make sure that the nozzle 18 is not activated for printing during the measurement process. For example, the time between the two printed points (i.e. the time between the print data points 202 and 208) is be sufficiently large. In an exemplary embodiment, the start of the measurement takes place only after a certain duration after the last ejection of a drop.

In an exemplary embodiment, Step 402 may optionally be omitted. In this case, Step 406 is implemented if a predetermined time has elapsed since the last ejection of ink from the nozzle. In this example, no determination of the real curve of the activation current of the piezoelement 22 is required.

According to exemplary embodiments, the status of the ink in the ink chamber 14 may be checked with the aid of the device 10 shown in FIG. 1*a*. In an exemplary embodiment, the device 10 includes the measurement sensor 24 and the evaluator 30. For example, the evaluator 30 comprises the ADC 32. In an exemplary embodiment, the evaluator 30 may be, for example, a computer. The computer may include a special software that includes instructions that when executed by a processor, cause the processor to perform the functions and operations of the evaluator 30.

In an exemplary embodiment, the measurement pulse 104 is applied—by the controller 28 (for example a printer controller or a "driving board")—across a defined frequency spectrum to one or more corresponding nozzles to measure the status of the ink in the nozzle 18 of the ink print head 12 shown in FIG. 1*a*. For example, the point in time $t_{calc}$ for this measurement pulse 104 is predetermined by an algorithm that, for each nozzle 18, tests the time between two image points or pixels that are to be printed, for example the last printed pixel and the following pixel.

In the event that the time between the last printed pixel and the following pixel (i.e. the printing pause) reaches or exceeds a predetermined threshold, the measurement pulse 104 or the measurement signal 101*a* may be applied to the nozzle 18, and thus the status of the ink in the nozzle 18 may be examined. In an exemplary embodiment, this time period is very long so that the measurement may be implemented, and a wait/delay also additionally take place before the measurement is started. For example, the status of the ink in the nozzle 18 is measured via the current consumption (I) over a frequency band, as was described using FIGS. 4*a* and 4*b*. The response signal 110 may also be relayed via the ADC 32 to a computer (e.g., evaluator 30). The software of the computer can be configured to analyze the response signal 110, for example. The status of the ink in the nozzle 18 is reflected in particular in the amplitude of the response signal 110 or the current consumption (I) according to FIGS. 4*a* and 4*b*, i.e. in the response of the piezoelement 22.

According to exemplary embodiments, the real curve of the activation current of the piezoelement 22 may be compared with a predetermined nominal curve that, for example, was acquired with the same method after a cleaning cycle. If the nominal curve corresponds to the real curve, the examined nozzle 18 has the nominal status and functions as desired. If the real curve deviates from the nominal curve, in particular an error is detected, and suitable measures may be taken to clean the nozzle 18.

After a cleaning cycle, the status of the cleaned ink print head 12 can be acquired with the device 10 using the measurement pulse 104 shown in FIG. 2*b*. During the printing process, when and how long a nozzle 18 has not been used may be determined with the aid of the pixel preview. The measurement pulse 104 shown in FIG. 2*b* or the measurement signal 101*a* shown in FIG. 2*a* may then be applied to the nozzle 18 via the controller 28. The response signal 110 may then be evaluated by the computer (e.g., evaluator 30). In the event that the response signal 110 has the curve shown in FIG. 4*a*, for example, the nozzle is working properly. In the event that the response signal 110 has the curve shown in FIG. 4*b*, for example, suitable measures can be taken, for example, a cleaning or the application of prefire pulses.

The present disclosure includes a "pixel preview" function. Whether the time period for the measurement between two ejection points in time is sufficiently large is detected with the aid of the pixel preview. A variable NPT may also be used in the printing operation to characterize suitable "refresh" (reestablishment) measures. Various influencing variables—for example the print head type, the nip environment and/or ambient environment, the print speed and/or special modes (for example pause function, what is known as "inspection mode")—may hereby be taken into account.

For example, the aforementioned "pixel preview" function may be used as a pre-stage for a "prefire" function. The combination of the "prefire" function and the "pixel preview" function for characterize of nozzle malfunction may be realized in the following processes, for example, in particular during or after the rastering process, during or after the corrugation process or during or after the job creation. For example, the faulty nozzle behavior is compensated via a "purge and wipe" (cleaning) process.

The exemplary embodiments has the following advantages. The detection of faulty nozzles during the printing operation is enabled without influencing the printing operation. It is enabled to detect print quality disruptions without a complicated camera engineering. The integration of the measurement method into a closed loop system is enabled in order to compensate for non-printing nozzles (for example) via neighboring nozzles. Moreover, an improvement of the print quality during continuous printing (pixel positioning) is achieved. It is achieved that there are no dried-out nozzles, such that a loss of image information may be avoided. A higher productivity of the printing machine may be achieved since fewer internal servicing intervals are necessary. A reduced ink consumption may also be achieved since fewer refresh measures are necessary. Furthermore, a greater ink system diversity may be achieved in "inkjet" printing machines (for example a "drop-on-demand" ink printer) in which the device according to the present disclosure can be used. There is no or only a slight load due to the refresh measures that are applied.

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 device
12 ink print head
13, 15 ink drops
14 ink chamber
16*a*, 16*b* wall elements
18 nozzle
20 nozzle channel
22 piezoelement
24 measurement sensor
26 controller
28 evaluator
30 Analog-to-Digital converter (ADC)
34 comparator
100, 101*a*, 101*b* sequence of control pulses
102 to 108 control pulse
110, 112, 114*a*, 114*b* response signal
116 error information signal
118, 410 feedback path
200 print data stream
201, 202 and 208 print data points
302, 304 signal curve
400 method
402 to 408 steps of the method

What is claimed is:

1. A method to reduce a locally increased viscosity of ink in an ink print head of an ink printer, comprising:

determining a printing pause of a nozzle of the ink print head that is to be examined using a pixel preview;

applying, in the determined printing pause, a first sequence of pulses having adjustable parameters to a piezoelement of the ink print head if the determined printing pause reaches or exceeds a predetermined threshold;

determining a real curve of an activation current of the piezoelement based on at least one of the adjustable parameters of the first sequence of pulses;

comparing the determined real curve with a predetermined nominal curve of the activation current of the piezoelement;

detecting, based on the comparison, whether a failure of the nozzle is likely to occur due to a locally increased viscosity of the ink at an exit of the nozzle in comparison to an initial viscosity of the ink; and applying a second sequence of pulses having adjustable parameters to the piezoelement, based on the detection whether the failure of the nozzle is likely to occur, to generate a vibration of a meniscus of the ink at the exit of the nozzle to intermix the ink having locally increased viscosity with ink having the initial viscosity, wherein, upon the application of the second sequence of pulses, a count of the pulses of the second sequence of pulses is set based on a deviation of the real curve of the activation current from the nominal curve of the activation current.

2. The method according to claim 1, wherein the adjustable parameters of the first sequence of pulses and the adjustable parameters of the second sequence of pulses respectively include an adjustable frequency, an adjustable amplitude and/or an adjustable number of pulses of the respective sequence.

3. The method according to claim 1, wherein:

upon the application of the first sequence of pulses, a frequency the first sequence of pulses is set; and the determination of the real curve of the activation current is implemented based on the frequency.

4. The method according to claim 1, wherein an amplitude of the first sequence of pulses and an amplitude of the second sequence of pulses are respectively fixed.

5. The method according to claim 1, wherein an ejection of ink drops from the nozzle does not take place if the first sequence of pulses or the second sequence of pulses is applied.

6. The method according to claim 1, wherein the nominal curve of the activation current is obtained based on an activation current determined immediately after a flushing of the nozzle.

7. The method according to claim 1, wherein the initial viscosity corresponds to a minimal viscosity of the ink in the ink print head.

8. The method according to claim 1, wherein the printing pause is determined from print data points of a data stream configured to generate a corresponding print image.

9. The method according to claim 1, wherein:

the first sequence of pulses and the second sequence of pulses are generated by a controller; and the comparison of the real curve of the activation current with the nominal curve of the activation current obtained using an evaluator.

10. A non-transitory computer-readable storage medium with an executable program stored thereon, wherein the program instructs a processor to perform the method of claim 1.

11. A printer configured to perform the method of claim 1.

* * * * *